US009822748B2

(12) United States Patent
Trocki et al.

(10) Patent No.: US 9,822,748 B2
(45) Date of Patent: Nov. 21, 2017

(54) RESTRICTIVE FLOW PASSAGE IN COMMON RAIL INJECTORS

(71) Applicant: CUMMINS INC., Columbus, IN (US)

(72) Inventors: Marian Trocki, Columbus, IN (US); Donald J. Benson, Columbus, IN (US); Tamas Rauznitz, Columbus, IN (US); Vijaygandeeban Subbaihaannadurai, Columbus, IN (US); Deepak Sahini, Columbus, IN (US)

(73) Assignee: Cummins Inc., Columbus, IN (US)

( * ) Notice: Subject to any disclaimer, the term of this patent is extended or adjusted under 35 U.S.C. 154(b) by 116 days.

(21) Appl. No.: 14/292,860

(22) Filed: May 31, 2014

(65) Prior Publication Data

US 2015/0345450 A1 Dec. 3, 2015

(51) Int. Cl.

| | |
|---|---|
| ***F02M 61/12*** | (2006.01) |
| ***F02M 61/04*** | (2006.01) |
| ***F02M 45/12*** | (2006.01) |
| ***F02M 63/00*** | (2006.01) |

(52) U.S. Cl.

CPC ..... *F02M 61/042* (2013.01); *F02M 45/12* (2013.01); *F02M 61/12* (2013.01); *F02M 63/0056* (2013.01); *F02M 2200/28* (2013.01); *F02M 2200/306* (2013.01)

(58) Field of Classification Search

CPC ..... F02M 61/168; F02M 61/18; F02M 61/12; F02M 51/0671; F02M 61/165; F02M 61/1853

USPC ..... 239/584

See application file for complete search history.

(56) References Cited

U.S. PATENT DOCUMENTS

| | | | | | |
|---|---|---|---|---|---|
| 2,959,360 | A | | 11/1960 | Nichols | |
| 4,249,497 | A | * | 2/1981 | Eheim | F02M 47/025 123/446 |
| 4,258,883 | A | | 3/1981 | Hoffmann et al. | |
| 4,427,152 | A | * | 1/1984 | Sisson | F02M 57/024 123/502 |
| 4,545,352 | A | * | 10/1985 | Jourde | F02M 47/027 123/447 |
| 4,627,571 | A | * | 12/1986 | Kato | F02M 47/02 123/467 |
| 4,684,067 | A | * | 8/1987 | Cotter | F02M 45/083 123/467 |
| 4,798,186 | A | * | 1/1989 | Ganser | F02M 47/027 123/446 |
| 4,987,887 | A | | 1/1991 | Kelly | |

(Continued)

*Primary Examiner* — Chee-Chong Lee

(74) *Attorney, Agent, or Firm* — Faegre Baker Daniels LLP

(57) ABSTRACT

An injector has an injector body including an injector cavity defining an inner wall and a longitudinal axis, an injector orifice and a plunger slidably disposed within the injector cavity. The plunger has an outer portion and an inner portion at different locations longitudinally along the plunger. The inner portion has a plurality of surface portions including a guiding portion configured to substantially mate with the inner wall of the injector cavity, guide the plunger to slidably move in a direction along the longitudinal axis and substantially prevent the plunger from laterally translating within the injector cavity. The plurality of surface portions also includes a restriction portion configured to form a restrictive cavity between an exterior surface of the inner portion and the inner wall of the injector cavity axially along a length of the inner portion.

23 Claims, 6 Drawing Sheets

(56) References Cited

U.S. PATENT DOCUMENTS

| | | | | |
|---|---|---|---|---|
| 5,020,500 | A | 6/1991 | Kelly | |
| 5,996,908 | A | 12/1999 | Hoffmann et al. | |
| 6,053,425 | A | 4/2000 | Stringfellow | |
| 6,499,467 | B1 | 12/2002 | Morris et al. | |
| 6,910,643 | B2 | 6/2005 | Dantes et al. | |
| 7,188,788 | B2 | 3/2007 | Augustin | |
| 7,690,588 | B2 | 4/2010 | Gibson et al. | |
| 7,971,802 | B2 | 7/2011 | Male et al. | |
| 2002/0056768 | A1 | 5/2002 | Czimmek | |
| 2006/0032948 | A1* | 2/2006 | Smout ..... | F02M 45/086<br>239/533.2 |

* cited by examiner

RESTRICTIVE FLOW PASSAGE IN COMMON RAIL INJECTORS

TECHNICAL FIELD

The invention relates generally to common rail direct fuel injectors. In particular, the invention relates to a closed nozzle fuel injector.

BACKGROUND

Internal combustion engines typically use common rail injectors as a direct fuel injection system to pump fuel pulses into a combustion chamber. A commonly used injector is a closed-nozzle injector which includes a nozzle assembly having a needle valve positioned adjacent a nozzle orifice for resisting blow back of exhaust gas into the pumping or metering chamber of the injector while allowing fuel to be injected into the cylinder. The needle valve is disposed within a nozzle cavity and is designed to be biased towards a closed position to block fuel flow through the nozzle orifices. There is a continuing need for an improved closed nozzle injector design that provides, for example, more efficient manufacturing options and/or enhanced performance features when compared to existing nozzle injector designs.

SUMMARY

Embodiments of the present invention include an injector for injecting fuel at high pressure into the combustion chamber of an engine. The injector has an injector body including an injector cavity defining an inner wall and a longitudinal axis, and an injector orifice communicating with one end of the injector cavity to discharge fuel. The injector also includes a plunger slidably disposed within the injector cavity adjacent the injector orifice. The plunger includes an outer portion and an inner portion at different locations longitudinally along the plunger. The outer portion has a first cross-sectional area. The inner portion has a second cross-sectional area that is larger than the first cross-sectional area and a plurality of surface portions including a guiding portion configured to substantially mate with the inner wall of the injector cavity. The guiding portion guides the plunger to slidably move in a direction along the longitudinal axis and substantially prevents the plunger from laterally translating within the injector cavity. The plurality of surface portions also includes a restriction portion configured to form a restrictive cavity between an exterior surface of the inner portion and the inner wall of the injector cavity axially along a length of the inner portion, producing a pressure drop along the restrictive cavity and biasing the needle towards the closed position.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

Figure 1:
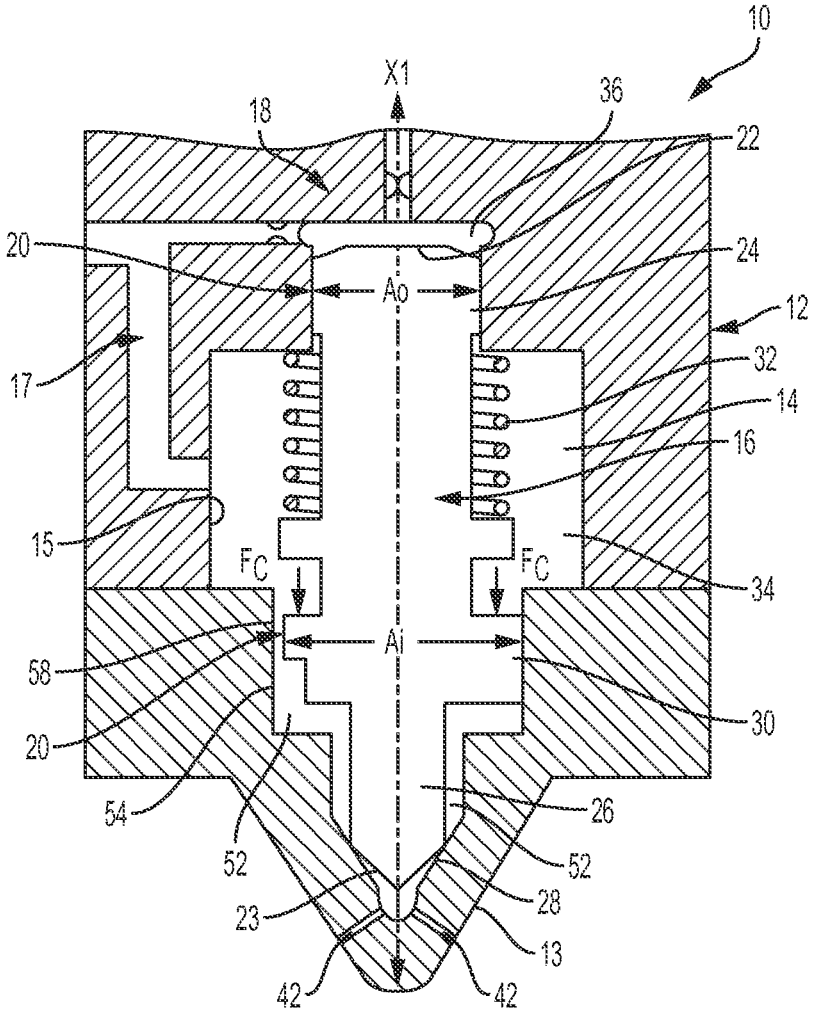
FIG. 1 is a schematic sectional illustration of a fuel injector assembly, according to embodiments of the present invention.

While the invention is amenable to various modifications and alternative forms, specific embodiments have been shown by way of example in the drawings and are described in detail below. The intention, however, is not to limit the invention to the particular embodiments described. On the contrary, the invention is intended to cover all modifications, equivalents, and alternatives falling within the scope of the invention as defined by the appended claims.

DETAILED DESCRIPTION

Throughout this application, the words "inward", "innermost", "outward" and "outermost" will correspond to the directions, respectively, toward and away from the point at which fuel from an injector is actually injected into the combustion chamber of an engine. The words "upper" and "lower" will refer to the portions of the injector assembly which are, respectively, farthest away and closest to the engine cylinder when the injector is operatively mounted on the engine.

FIG. 1 shows a simplified, cross-sectional schematic illustration of a first embodiment of a fuel injector, denoted by numeral 10 (also described as a closed nozzle fuel injector or, more generally, a common rail fuel injector), in accordance with embodiments of the present invention. The fuel injector 10 is used to inject fuel at high pressure into a combustion chamber (not shown) of an engine. The fuel injector 10 can be adapted for use with a variety of injectors and fuel systems. For example, the fuel injector 10 may receive high pressure fuel from a high pressure common rail or alternatively, a dedicated pump assembly, such as in a pump-line-nozzle system or a unit injector system incorporating, for example, a mechanically actuated plunger into an injector body. The fuel injector 10 generally includes an injector body 12 including a nozzle 13 and an injector cavity 14 (also described as an interior region, a bore or a lumen) including a fuel inlet 17 and injection orifices 42. The injector cavity 14 defines an inner wall 15 and a longitudinal axis X1. The injector cavity 14 houses a needle valve 16 (also described as a plunger) mounted for reciprocating motion in the injector cavity 14 along the longitudinal axis X1 and a needle valve actuating system 18.

As shown in FIG. 1, the needle valve 16 has a valve seat portion 26 positioned at an inner end 23 that sealingly engages a valve seat 28 of the nozzle 13 when the needle valve 16 is in a closed position. An outer end 22 of the needle valve 16 interacts with the needle valve actuating system 18 as desired. In some embodiments, the needle valve 16 is biased into the closed position by biasing mechanisms within the injector cavity 14, for example, a bias spring 32 and a needle valve actuating system 18. The needle valve actuating system 18 controls the flow of fuel entering the inlet 17 and the outer end 22 of the injector cavity 14 to help control the movement of the needle valve 16 between an open position and the closed position. Biasing mechanisms that include the bias spring 32 and the needle valve actuating system 18 are generally described in U.S. Pat. No. 6,499,467, entitled Closed Nozzle Fuel Injector With Improved Controllability, which is incorporated herein by reference in its entirety.

The needle valve 16 also includes needle valve biasing features 20 to enhance the opening and closing rates of the needle valve 16 for more accurate control of fuel injection, according to some embodiments. The needle valve biasing features 20 optionally include an inner portion 30 and an outer portion 24 of the needle valve 16 and, more specifically, the relative sizing of inner and outer portions 30, 24 to achieve desirable fuel pressure biasing forces on needle valve 16 during an injection event. In some embodiments, the inner portion 30 may include a cross-sectional area (Ai) (also described in terms of a radial length, a diameter, or an alternative transverse dimension) that is larger than the cross-sectional area (Ao) of the outer portion 24 to produce a pressure drop and create a biasing closing force on the needle valve 16.

The needle biasing features 20 also optionally include the inner portion 30 that forms a restriction passage 58 (also described as a passage, cavity, slot or clearance). The restriction passage 58 restricts the flow of fuel from the outer cavity 34 into an inner control volume 52 when the fuel injector 10 is in an open position to create a desired force profile on the needle valve 16. The inner control volume 52 is an area that surrounds the valve seat portion 26 and contains fuel for injection into an engine combustion chamber when the fuel injector 10 is in an open position. The flow restriction causes a small pressure drop across the restriction passage 58 that produces a higher pressure in the injector cavity 14 than the inner control volume 52. Consequently, the restriction passage 58 helps to increase the resulting force on the needle valve 16 during the injection event by creating fuel pressure biasing forces on the needle valve 16 towards the closed position.

In sum, the needle biasing features help generate a significant downward force (Fc) on the needle valve 16 using the small pressure drop between the outer cavity 34 and the inner control volume 52 created by the restriction passage 58, for conditions where the needle is lifted from its valve seat 28. Advantages achieved by producing the desired closing force (Fc) on the needle valve 16 include slowing down the opening of the needle valve 16 and speeding up the closing of the needle valve 16 to generally enhance fuel injection control and accuracy and improve emissions.

Figure 2:
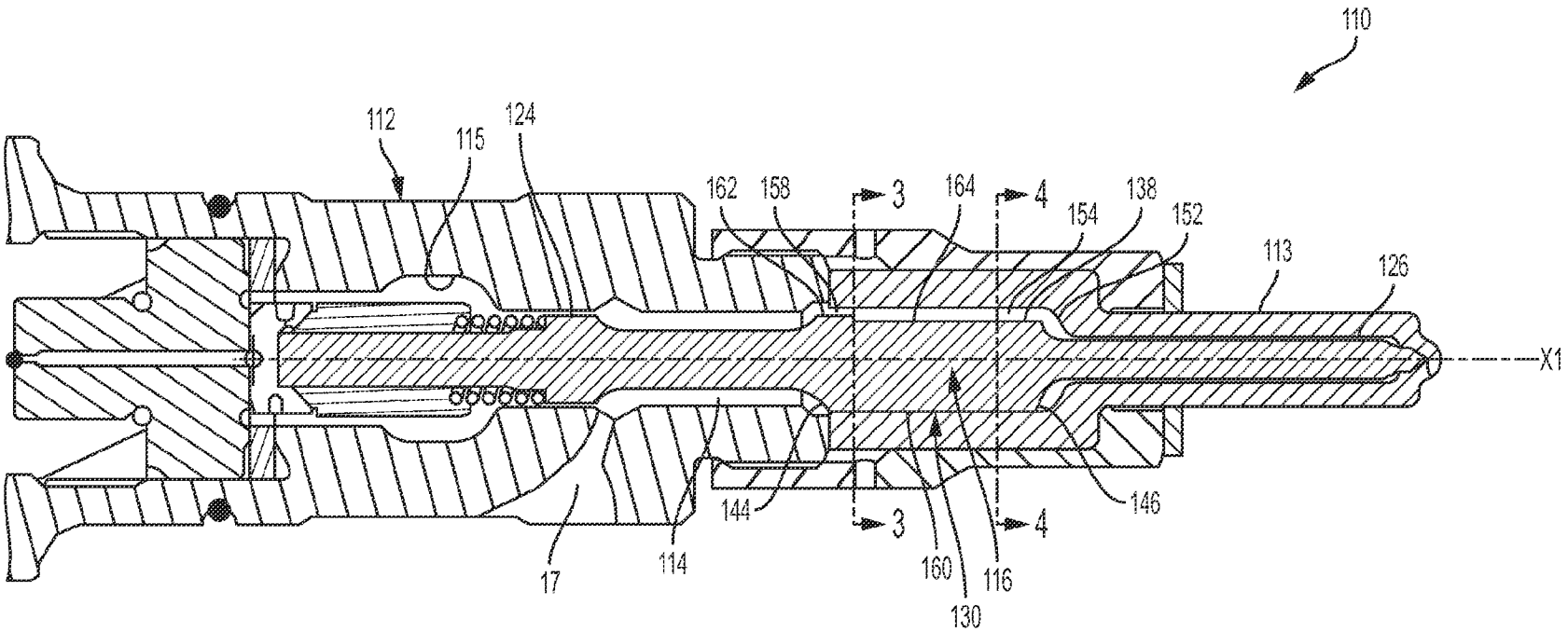
FIG. 2 is a schematic longitudinal sectional view of an alternative embodiment of a fuel injector, according to embodiments of the present invention.

FIG. 2 is a schematic longitudinal sectional view of second embodiment of a fuel injector, denoted by numeral 110, in accordance with embodiments of the present invention. As shown, the first and second embodiments of the fuel injector 110, 10 are optionally substantially similar, and thus various features of the second embodiment of the fuel injector 110 are described in association with the previously discussed fuel injector 10. The fuel injector 110 is shown in greater detail in FIG. 2, according to some embodiments. In FIG. 2, a needle valve 116 includes an outer portion 124 having an outer peripheral extent sized and positioned to form a flow passage between the outer portion and an inner wall 115 of an injector cavity 114. The flow passage between exterior surface of the outer portion 124 and the inner wall 115 of an injector body 112 optionally creates a flow between the outer portion 124 and the opposing surface of injector body 112 forming the injector cavity 114, according to some embodiments. In some embodiments, a bias spring 32 is disposed about at least a portion of the outer portion 124.

The needle valve 116 also includes an inner portion 130 having a plurality of surface portions 138 circumferentially spaced about the exterior surface of the inner portion 130. In some embodiments, the plurality of surface portions 138 includes a guiding portion 160 (also described as a first portion or a guiding feature), a restriction portion 162 (also described as a second portion, gain orifice, restriction orifice, restriction feature or a biasing feature), a clearance portion 164 (also described as a third portion or a clearance orifice), and/or combinations thereof.

At least one of the plurality of surface portions 138 includes the guiding portion 160, according to some embodiments. The guiding portion 160 is optionally configured to substantially mate with the inner wall 115 of the injector cavity 114, more specifically, the inner wall 115 of a nozzle 113. The guiding portion 160 optionally guides the needle valve 116 such that the needle valve 116 slidably moves within the injector cavity 114 along the longitudinal axis X1. In some embodiments, the guiding portion 160 includes at least two points of contact, wherein the two points of contact are 180 degrees apart to prevent the needle valve 116 from laterally translating during needle valve actuation. In some embodiments, the guiding portion 160 is sized and shaped to form a close sliding fit between at least a portion of the needle valve 116 and the inner wall 115 of the injector cavity 114. The guiding portion 160 is optionally a curved, convex mating surface complementary to a concave interior of the injector cavity 114 at the nozzle 113, according to some embodiments. For example, in some embodiments, the guiding portion 160 is a circular or an elliptical surface portion that mates to a complementary surface of the inner wall 115.

The guiding portion 160 optionally extends along a given length of the inner portion 130 in a longitudinal direction, also described as an axial direction. In some embodiments, the guiding portion 160 extends longitudinally along at least a portion of the length of the inner portion 130 of the needle valve 116. In other embodiments, the guiding portion 160 extends longitudinally along the entire length of the inner portion 130 of the needle valve 116. In alternative terms, the needle valve 116 optionally includes a longitudinal, continuous guiding portion 160 that extends from a first end 144 of the inner portion 130 to a second, opposite end 146 of the inner portion 130.

As shown in FIG. 2, the plurality of surface portions 138 of the inner portion 130 also includes the restriction portion 162. In some embodiments, the restriction portion 162 is a flat surface. In other embodiments, the restriction portion 162 is a concave surface. The restriction portion 162 may include many other surface shapes or contours so long as the restriction portion 162 allows fuel to flow between the exterior surface of the inner portion 130 of the needle valve 116 and the inner wall 115 of the injector cavity 114. As such, the restriction portion 162 essentially forms a restriction passage 158 between the exterior surface of the inner portion 130 of the needle valve 116 and the inner wall 115 of the injector cavity 114, as desired. An inner control volume 152 is shown downstream of the restriction passage 158. The restriction portion 162 is longitudinally adjacent to the clearance portion 164 of the inner portion 130, in some embodiments.

At least one of the plurality of surface portions 138 includes the clearance portion 164, according to some embodiments. The clearance portion 164 is optionally longitudinally located between the restriction portion 162 and the valve seat portion 126 of the needle valve 116. In FIG. 2, the clearance portion 164 forms the clearance area 154 between the exterior surface of the needle valve 116 and the inner wall 115 of the injector cavity 114. The clearance area 154 optionally has a larger cross-sectional area than the restriction passage 158 to minimize pressure losses in the fuel injector cavity 114. The clearance area 154 controls the amount of pressure relief in the fuel injector system 110 that, in turn, can affect the amount of a fuel injection and fuel injection time.

In some embodiments, clearance portion 164 having a uniform surface shape or contour forms the clearance area 154 with a constant cross-sectional area. In other embodiments, the clearance portion 164 having a surface shape or contour that varies longitudinally along the length of the inner portion 130 forms the clearance area 154 with a cross-sectional area that varies longitudinally along the length of the inner portion 130. The restriction passage 158 and clearance area 154 are optionally formed in the needle valve 116, injector housing 112, nozzle 113 and/or combinations thereof.

Figure 3:
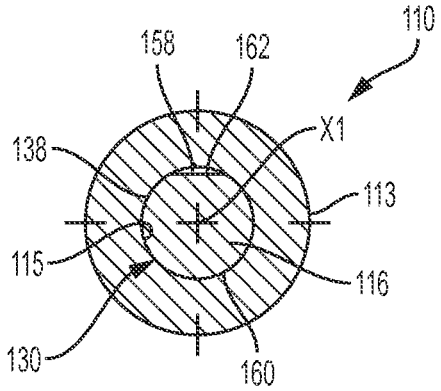
FIGS. 3 and 4 are schematic transverse sectional views of the fuel injector taken at lines 3-3 and 4-4 of FIG. 2, respectively, according to embodiments of the present invention.
Figure 4:
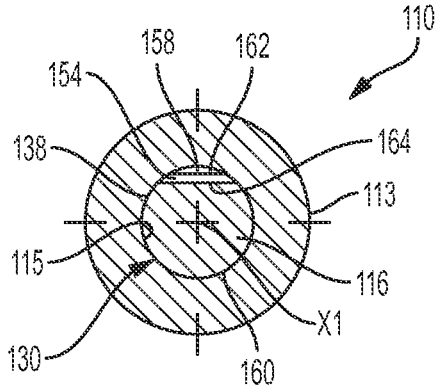

FIGS. 3 and 4 are schematic transverse sectional views of the second embodiment of the fuel injector 110 of FIG. 2 at two different longitudinal locations along the injector 110. The restriction portion 162 optionally forms the restriction passage 158 between the exterior surface of the needle valve 116 and the inner wall 115 of the injector cavity 114. For example, as shown in FIG. 3, the restriction portion 162 with a flat surface forms the restriction passage 158 with a semi-circular or a non-annular cross-section between the exterior surface of the needle valve 116 and the inner wall 115 of the injector cavity 114. The restriction portion 162 is circumferentially adjacent to the guiding portion 160 of the needle valve 116, according to some embodiments.

In some embodiments, the restriction portion 162 is a concave surface that forms a longitudinal channel. In some embodiments, the inner portion 130 has optionally one channel or multiple channels. In some embodiments, the restriction portion 162 optionally forms a longitudinal channel of a constant cross-section. In some embodiments, the restriction portion 162 optionally forms a longitudinal channel of a varying cross-section.

The shape of the longitudinal channel optionally includes, but is not limited to, a curved, concave channel, for example, a hemispherical channel or oval channel. In some embodiments, the restriction portion 162 has a radius of curvature that is different than the radius of curvature of the inner wall 115 of the injector cavity 114. In some embodiments, the radius of curvature of the restriction portion 162 is greater than the radius of curvature of the inner wall 115. Alternatively, in some embodiments, the radius of curvature of the restriction portion 162 is less than the radius of curvature of the inner wall 115. In other embodiments, the channel is a polygonal shaped channel, for example, a substantially rectangular or square channel. Other cross-sectional shapes may be also contemplated for the constant restriction injector 110 to form the restriction passage 158 in the inner wall 116 and create a pressure drop across the restriction passage 158.

The surface shape of the restriction portion 162 and the contour of the inner wall 115 together form the restriction passage 158. In FIG. 3, the semi-circular cross-section restriction passage 158 is defined by a first radius formed by the inner wall 115 and a flat surface of the inner portion 130, as desired. In some embodiments, the restriction passage 158 is shaped by the first radius formed by the inner wall 115 and a surface contour of the longitudinal channel, for example, a substantially rectangular or hemispherical channel.

The shape of the restriction portion 162 can optionally create two different types of fuel injectors, a constant restriction injector 110 (also described as a constant force biasing injector) and a variable restriction injector 510 (also described as a variable force biasing injector). In the constant restriction injector, the restriction portion 162 has a uniform geometry, or cross-sectional shape, along a longitudinal length of the inner portion 130, as shown in FIGS. 2-4. As such, in some embodiments, the restriction passage 158 maintains a constant cross-sectional area regardless of the needle valve position, according to some embodiments. The constant restriction injector 110 is configured to create operational zones within the cavity 14 in which the needle valve 116 can axially translate without substantially changing the restrictive magnitude and the biasing force magnitude.

In contrast to the constant restriction injector, the variable restriction injector 510 is configured to create operational zones in which the restriction magnitude and the biasing force magnitude change as the needle valve 116 axially translates within the injector cavity 114. In the variable restriction injector 510, which will be discussed with FIGS. 9-12 in sections hereafter, the restriction portion 162 has a geometry, or cross-sectional shape, that varies along at least a portion of the longitudinal length of the inner portion 130.

There may be several factors for determining a suitable longitudinal length for the restrictive portion 162. In various embodiments, the restrictive portion 162 may be of any suitable length that is compatible for a single, multiple or for all injector types and sizes. In some embodiments, the longitudinal length is based on suitable manufacturing and/or operational factors and tolerances. For example, in some embodiments, a suitable longitudinal length for the restrictive portion 162 is manufacturably reproducible and/or measureable. According to some embodiments, the length of the restrictive portion 162 is adapted to adjust the magnitude of the restriction (e.g. pressure drop) over a range of fuel viscosities. In some embodiments, the restrictive portion 162 may have longitudinal lengths in the range of about 1.0 mm to 10 mm, for example. Suitable length ranges also include about 1.0 mm to 8 mm, about to 1 mm to 5 mm or about 1.0 mm to 2.0 mm, for example In some embodiments, the longitudinal length of the restrictive portion 162 for a variable restriction injection 510 is dependent on the axial travel length of the needle valve from a closed to an open position. For example, in various embodiments, the restrictive portion 162 is the same (or similar) to or larger than the axial travel length of the needle valve from the closed to open position.

There may be several factors for determining a suitable depth of the longitudinal channel. The depth of the longitudinal channel may be defined as a radial length difference between a portion of the inner portion 130 with the channel and a portion of the inner portion 130 without the channel. The longitudinal channel may be any suitable depth that is adapted to affect a magnitude of the restriction (e.g. pressure drop) and a magnitude of the closing force (Fc) in a particular, multiple or all operating conditions of the fuel injector. In various embodiments, a suitable depth is compatible for a single, multiple or for all injector types and sizes. In some embodiments, the suitability of the depth is based on manufacturing and/or operational factors and tolerances. For example, a suitable depth for the restrictive portion 162 is manufacturably reproducible and/or measureable, in some embodiments.

In some embodiments, the restrictive portion 162 may have a depth in the range of about 0.20 mm to 3.0 mm, for example. Suitable length ranges also include about 0.20 mm to 1.50 mm, about to 0.80 mm to 1.30 mm or about 0.30 mm to 0.50 mm, for example In FIG. 4, the clearance portion 164 is a flat surface that forms a clearance area 154 (also described as a passage, or cavity) having a semi-circular cross-section. The clearance portion 164 is located about the exterior surface of the inner portion 130 along a longitudinal length of the inner portion 130, as desired. The clearance portion 164 is circumferentially adjacent to the guiding portion 160 of the needle valve 116, according to some embodiments. The clearance portion 164 may optionally include one of various surface shapes that, in turn, form a clearance area 154 of a different cross-sectional geometry. Exemplary cross-sectional geometries of the clearance area 154 include, but are not limited to, a semi-circular (also described as concave or hemispherical), oval, or polygonal cross-section.

Figure 5:
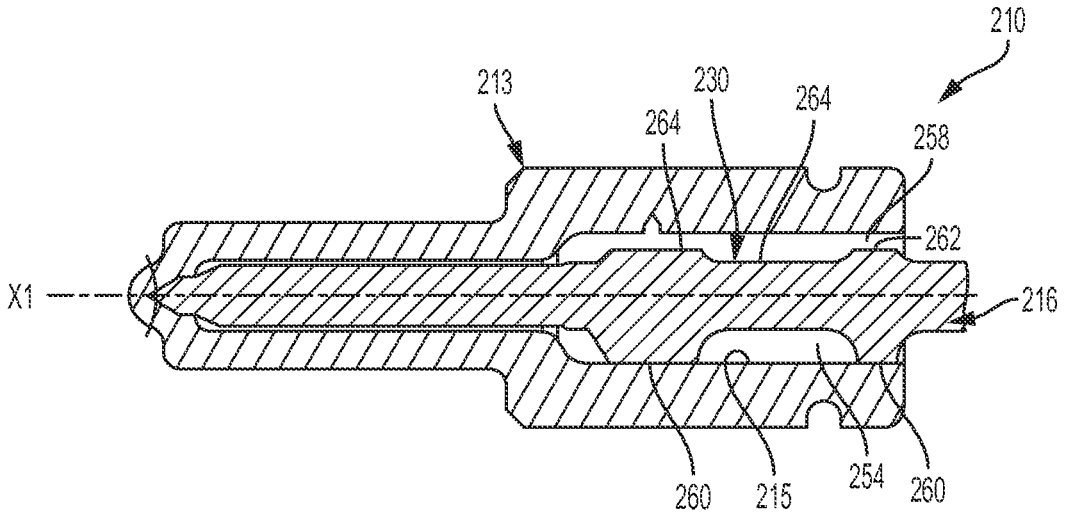
FIGS. 5 and 6 are schematic longitudinal sectional views of an alternative embodiment of a fuel injector, according to embodiments of the present invention.
Figure 6:
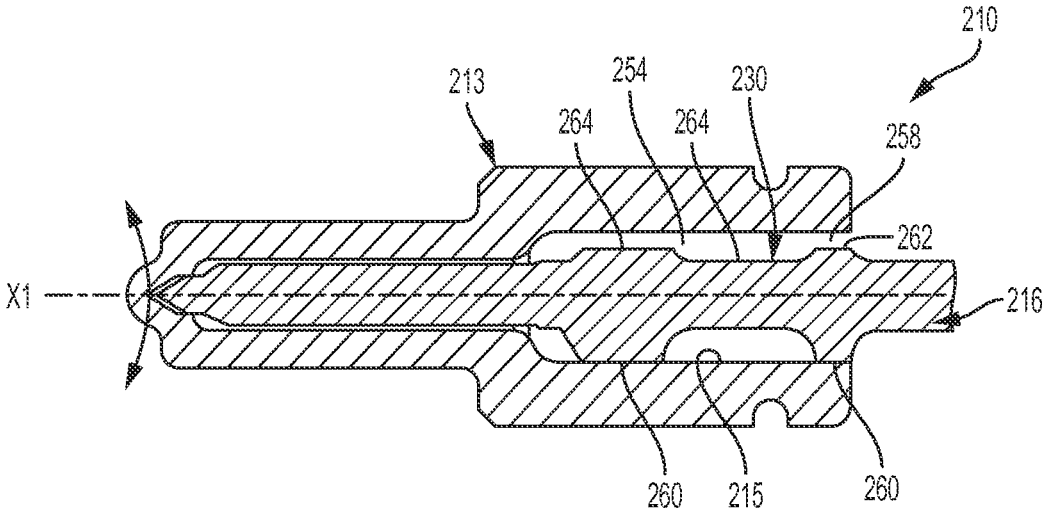

FIGS. 5 and 6 show schematic longitudinal sectional views of a third embodiment of a fuel injector 210 in a closed and an open position, respectively, in accordance with embodiments of the present invention. As shown, the third embodiment of the fuel injector 210 is a constant restriction fuel injector that generally includes a needle valve 216 disposed within a nozzle 213 having an inner wall 215 and defining the longitudinal axis X1. As shown, the third embodiment of the fuel injector 210 and the previously discussed embodiments of the fuel injector 110, 10 are optionally substantially similar, and thus various features of the third embodiment of the fuel injector 210 are described in association with the previously discussed fuel injectors 110, 10. Unlike the first and second embodiments of the fuel injector 10, 110, the third embodiment of the fuel injector 210 includes the needle valve 216 having a plurality of guiding portions 260 and clearance portions 264.

In FIGS. 5 and 6, an inner portion 230 of the third embodiment of the fuel injector 210 includes a plurality of guiding portions 260 at different longitudinal locations along the inner portion 230. For example, the circumference of the needle valve 216 may include a first guiding portion 260 circumferentially adjacent to a restriction portion 262 at a one longitudinal location, and a second guiding portion 260 circumferentially adjacent to a clearance portion 264 at a different longitudinal location. In some embodiments, a plurality of discrete guiding portions 260 are separated longitudinally by the clearance portion 264 along the length of the inner portion 230. In some embodiments, the first and second guiding portions 260 are circumferentially located about the exterior surface of the inner portion 230 such that the first guiding portion 260 is 180 degrees from the second guiding portion 260 to prevent the needle valve 216 from laterally translating during needle valve actuation. A plurality of guiding portions 160 can improve the alignment of the needle valve 216 within an injector cavity 214 during a reciprocating motion.

Also shown in FIGS. 5 and 6, the inner portion 230 includes a clearance portion 264 having a varying geometry axially along a given length of the inner portion 230. In some embodiments, the clearance portion 264 with a varying cross-section forms a clearance area 254 having a varying cross-sectional area along at least a portion of the needle valve 216 in the longitudinal direction. In alternative terms, the clearance portion 264 includes a varying surface portion, or contour, along at least a portion of the length of the needle valve 216. In some embodiments, the clearance portion 264 includes a full circumferential surface of the inner portion 230 along at least a portion of a longitudinal length of the needle valve 216. Stated differently, the clearance portion 264 is a circular cross-sectional surface that forms an annular clearance area 254 between the inner portion 230 and the inner wall 215 of the injector cavity 214, according to some embodiments.

Figure 7:
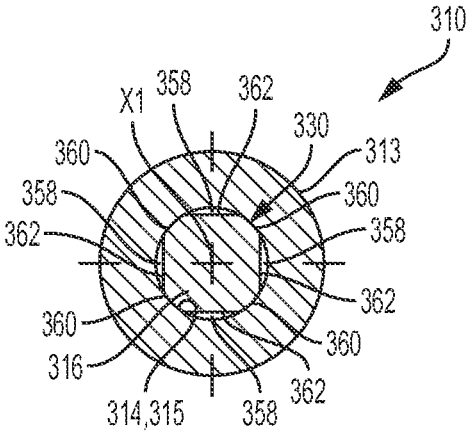
FIGS. 7 and 8 are schematic transverse views of alternative embodiments of a fuel injector, according to embodiments of the present invention.
Figure 8:
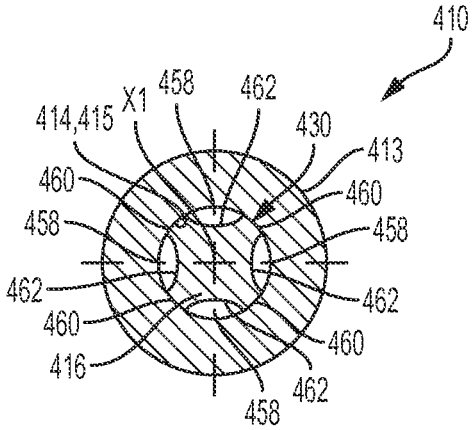

FIGS. 7 and 8 are schematic transverse views of a fourth and a fifth embodiment of a fuel injector 310, 410, respectively, in accordance with embodiments of the present invention. As shown, various embodiments shown in the fourth and fifth embodiments of the fuel injector 310, 410 and the previously discussed embodiments of the fuel injector 210, 110, 10 are optionally substantially similar, and thus various features of the fourth and fifth embodiments of the fuel injector 310, 410 are described in association with the previously discussed fuel injector embodiments. For example, as shown, the fourth and fifth embodiments of the fuel injector 310, 410 include a nozzle 313, 314 that is substantially similar to the nozzle 13, 113, 213 of previous discussed embodiments of the fuel injector 10, 110, 210. The difference between the present embodiments of the fuel injector 310, 410 and the other discussed embodiments is the design of an inner portion 330, 430, in particular, the inner portion 330, 430 that forms restriction passages 358, 458.

In FIGS. 7 and 8, the inner portion 330, 430 may include a plurality of restriction portions 362, 462 that are circumferentially spaced about the exterior surface of the inner portion 330, 430. The plurality of restriction portions 362, 462 are optionally at circumferentially spaced locations about the exterior surface of a needle valve 316, 416. In some embodiments, the restriction portions 362, 462 are equidistantly spaced about the exterior surface of the needle valve 316, 416. In other embodiments, the restriction portions 362, 462 are randomly spaced about the exterior surface of the inner portion 330, 430. Duplicating the restriction portions 362, 462 multiple times around the circumference of the needle valve 316, 416 helps to provide a more circumferentially balanced needle 316, 416.

In some embodiments, the inner portion 330, 430 includes a plurality of restriction portions 362, 462 of the various cross-sectional shapes, which were previously discussed herein. In FIG. 7, the fourth embodiment of the fuel injector 310 includes a plurality of restriction portions 362 form a plurality of flat surfaces at circumferentially spaced locations about the inner portion 330.

Alternatively, in some embodiments, a plurality of restriction portions 362 form a plurality of longitudinal channels. In FIG. 8, the fifth embodiment of the fuel injector 410 includes the plurality of concave restriction portions 462 that form the plurality of hemispherical channels at circumferentially spaced locations about the inner portion 430. The plurality of channels optionally includes various channel shapes, such as a hemispherical channel or a polygonal channel, as previously discussed herein.

A plurality of restriction portions 362, 462 forms a plurality of restriction passages 358, 458 wherein the shape and size of each restriction passage depends on the geometry of the restriction portion 362, 462 and the contour of an inner wall 315, 415 of an injector cavity 314, 414. The restriction passage optionally includes various shapes and sizes, such as a semi-circular passage 458 and other cross-sectional shapes, as previously discussed herein. In some embodiments, the restriction passages 358, 458 each have a constant cross-section between the needle valve 316, 416 and the cavity wall 15. In some embodiments, at least one of the plurality of restriction passages 358, 458 has a varying cross-section between the needle valve 316, 416 and the cavity wall 315, 415.

The needle valve 316, 416 also optionally has a plurality of guiding portions 360, 460 that are circumferentially spaced about the inner portion 330, 430. In alternative terms, the needle valve 316, 416 optionally has a plurality of guiding portions 360, 460 at circumferentially spaced locations about the exterior surface of the needle valve 316, 416. In some embodiments, the guiding portions 360, 460 are equidistantly spaced about the exterior surface of the needle valve 316, 416. In other embodiments, the guiding portions 360, 460 are randomly spaced about the exterior surface of the inner portion 330, 430.

Figure 10:
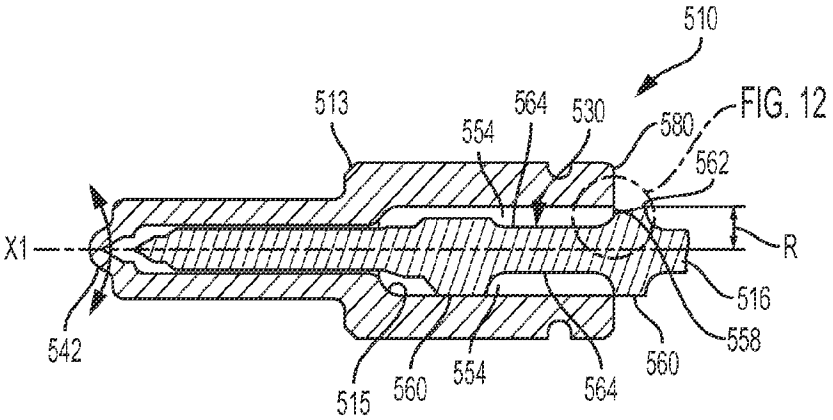
FIGS. 9 and 10 are schematic longitudinal sectional views of an alternative embodiment of a fuel injector, respectively, according to embodiments of the present invention.
Figure 9:
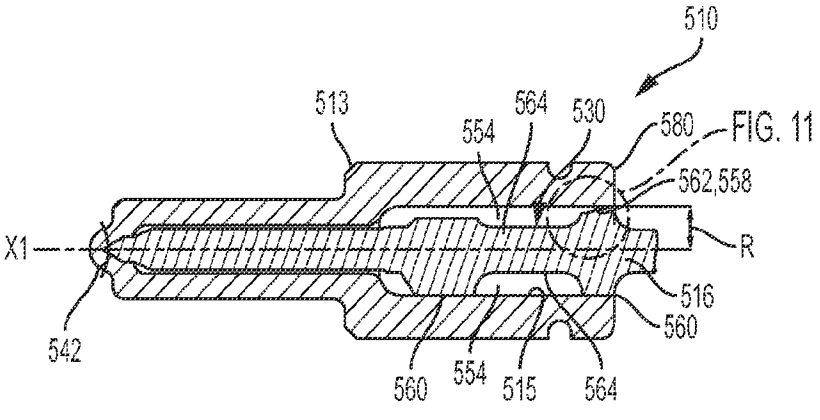

FIGS. 9 and 10 are schematic longitudinal sectional views of a sixth embodiment of the fuel injector 510, also described as the variable restriction injector, in the closed and the open position, respectively, in accordance with embodiments of the present invention. As shown, various embodiments shown in the sixth embodiment of the fuel injector 510 and the previously discussed fuel injectors 410, 310, 210, 110, 10 are optionally substantially similar, and thus various features of the sixth embodiment of the fuel injector 510 are described in association with the previously discussed fuel injectors. Unlike the previously discussed fuel injectors, the sixth embodiment of the fuel injector 510 includes an inner portion 530 with a restriction portion 562 designed for varying a restriction passage 558 as a function of needle valve position. As such, the variable restriction injector 510 may provide a variable injection rate shaping, i.e. change the fuel injection flow rate during an injection, for engine performance improvements and emission reductions.

As shown in FIGS. 9 and 10, the variable restriction injector 510 includes the restriction portion 562 that provides variable flow and pressure drop as a function of needle valve position within a nozzle 513. The restriction portion 562 of a given surface shape, as previously discussed herein, optionally changes a radial dimension R of the inner portion 530 along the different longitudinal locations along the inner portion 530. In some embodiments, the restriction portion 562 increases or decreases the radial dimension R of the inner portion 530 in an axial direction towards one or more injector orifices 542. In alternative terms, the radial dimension R of the restriction portion 562 at a first axial location P1 is less than or greater than the radial dimension R at a second axial location P2, wherein the second axial location P2 is closer to the injector orifices 542 than the first axial location P1.

Figure 12:
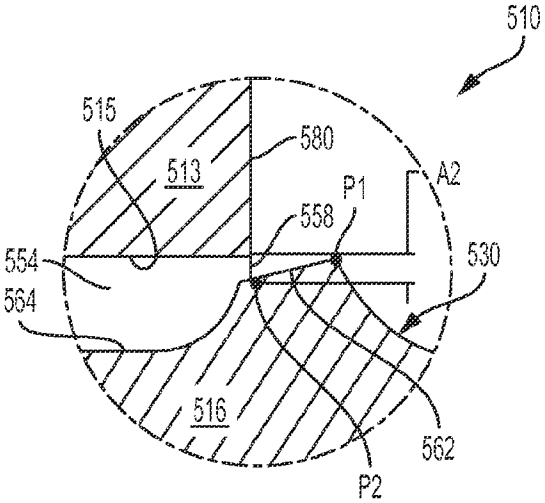
FIG. 12 is a schematic longitudinal sectional view of the restriction passage area of the fuel injector of FIG. 10, according to embodiments of the present invention.
Figure 11:
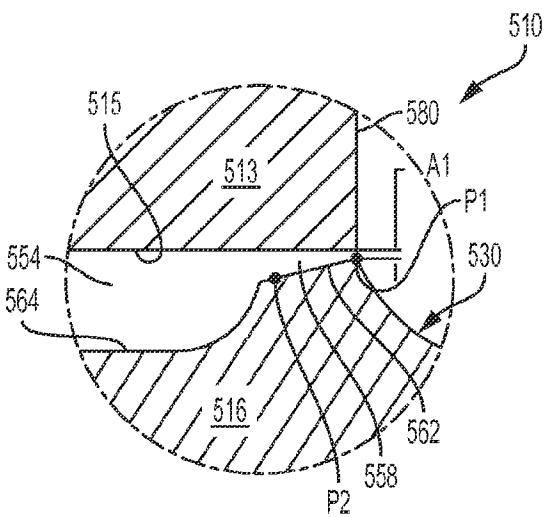
FIG. 11 is a schematic longitudinal sectional view of a restriction passage area of the fuel injector in FIG. 9, according to embodiments of the present invention.

FIGS. 11 and 12 are enlarged schematic sectional views of the variable restriction injector 510 in the closed and the open position, respectively, in accordance with embodiments of the present invention. When the injector 510 is the closed position (FIG. 11), the first axial location P1 of the restriction portion 562 is aligned with the first end 580 of the nozzle 513, creating a first restriction passage area A1 between the exterior surface of a needle valve 516 and an inner wall 515 of an injector cavity 514 at the nozzle 513. When the injector 510 is the open position (FIG. 12), the second axial location P2 of the restriction portion 562 is aligned with the first end 580 of the nozzle 513, creating a second restriction passage area A2 between the exterior surface of the needle valve 516 and the inner wall 515 of the nozzle 513. As such, the cross-sectional area of the restriction passage 558 between the needle valve 516 and the inner wall 515 changes as the needle valve 516 axially moves within the injector cavity 514. In some embodiments, the cross-sectional area of the restriction passage 558 increases as the needle moves from a closed position to the open position, thus the first restriction passage area A1 is smaller than second restriction passage area A2. In some embodiments, the change in cross-sectional areas of the restriction passage 558 between two axial locations P1, P2 is a gradual, smooth transition. For example, in FIGS. 9-12, the restriction portion 562 forms a tapered profile in the axial direction along a length of the inner portion 530. In other embodiments, there is an abrupt change in cross-sectional area of the restriction passage 558 between two axial locations P1, P2. For example, the restriction portion 562 may include a stepped profile having multiple flat surfaces of varying radial dimension at two or more two axial locations along the inner portion 530.

The variable restriction design optionally includes a restriction portion 562 with a single, or multiple slots or channels of any axial length required to change the magnitude of restriction as a function of the needle lift. In some embodiments, the inner portion 530 transitions from one channel to multiple channels axially along the inner portion 530. The restriction portion 562 is optionally duplicated multiple times around the circumference of the needle valve 516 to provide a more circumferentially balanced needle valve 516.

The present invention optionally provides manufacturing efficiencies that minimizes complex machining requirements for achieving desired fuel flow performance characteristics. The present invention may provide a less expensive injector design option because only the needle valve requires modification. As such, the present invention minimizes the need of using a nozzle with an inwardly protruding diameter to create a guiding section. The present invention also minimizes the need for complicated drilling and complex manufacturing equipment and processing. Thus, the present invention can reduce the manufacturing capital, time and processing costs.

The present invention may provide a simplified gain orifice design for common rail injectors. Furthermore, the embodiments of the present invention may provide an easier design for custom orifice sizing to achieve a particular injector output or make accommodation for a particular injector application.

The present invention may improve the performance of the common rail fuel system, for example, such as providing a variable injection rate shaping that can be utilized in engine performance improvements and emission reductions.

It is understood that the present invention is applicable to all internal combustion engines utilizing a fuel injection system and to all closed nozzle injectors including unit injectors. This invention is particularly applicable to diesel engines which require accurate fuel injection rate control. Such internal combustion engines including a fuel injector in accordance with the present invention can be widely used in all industrial fields and non-commercial applications, including trucks, passenger cars, industrial equipment, stationary power plant and others.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What is claimed is:

1. An injector for injecting fuel at high pressure into a combustion chamber of an engine, comprising:

an injector body including:

an injector cavity defining an inner wall and a longitudinal axis; and an injector orifice communicating with one end of the injector cavity to discharge fuel;

a plunger slidably disposed within the injector cavity adjacent the injector orifice, the plunger including an outer portion and an inner portion at different locations longitudinally along the plunger, the outer portion having a first cross-sectional area, the inner portion having a second cross-sectional area that is larger than the first cross-sectional area and a plurality of surface portions including:

a guiding portion configured to substantially mate with and directly slide on the inner wall of the injector cavity, guiding the plunger to slidably move in a direction along the longitudinal axis and substantially preventing the plunger from laterally translating within the injector cavity; and a restriction portion formed by an exterior surface of the inner portion disposed opposite the inner wall of the injector cavity along a length of the inner portion, the restriction portion and the inner wall forming a restriction passage therebetween to produce a pressure drop along the restriction passage and bias the plunger towards a closed position; and an actuating system to control the movement of the plunger between an open and the closed positions.

2. The injector of claim 1, wherein the restriction portion has a uniform geometry along a longitudinal length of the inner portion.

3. The injector of claim 1, wherein the restriction portion has a uniform geometry along an entire longitudinal length of the inner portion.

4. The injector of claim 1, wherein the restriction portion is a concave surface that forms a longitudinal channel.

5. The injector of claim 4, wherein the longitudinal channel is a hemispherical channel.

6. The injector of claim 1, wherein the restriction portion comprises a flat surface forming the restriction passage with a non-annular cross-section between the exterior surface of the plunger and the inner wall of the injector cavity.

7. The injector of claim 6, wherein the restriction passage has a semi-circular cross-section.

8. The injector of claim 1, wherein a surface shape of the restriction portion and a contour of the inner wall form the restriction passage.

9. The injector of claim 8, wherein the surface shape of the restriction portion and the contour of the inner wall form the restriction passage having a constant cross-sectional area regardless of a plunger position defined by a position of the plunger.

10. The injector of claim 1, wherein the plunger is configured to create operational zones within the injector cavity in which the plunger can axially translate without substantially changing the restrictive magnitude and the biasing force magnitude.

11. The injector of claim 1, wherein the guiding portion forms a circular surface portion that mates to a complementary surface of the inner wall.

12. The injector of claim 1, wherein the restriction portion has geometry that varies along the axial length of the inner portion.

13. The injector of claim 1, wherein the guiding portion includes at least two points of contact, wherein the two points of contact are 180 degrees apart to prevent the plunger from laterally translating during plunger actuation.

14. The injector of claim 1, wherein the plunger includes a valve seat portion defining an inner control volume formed between the valve seat portion and the injector cavity, wherein the plurality of surface portions of the inner portion include a clearance portion forming a clearance area between the exterior surface of the inner portion and the inner wall of the injector cavity that has a larger cross-sectional area than the restriction passage to minimize pressure losses in the injector cavity, and wherein the clearance portion is located between the restriction portion and the valve seat portion of the plunger.

15. An injector for injecting fuel at high pressure into the combustion chamber of an engine, comprising:

an injector body including: an injector cavity defining an inner wall and a longitudinal axis;

a plunger being slidably disposed within the injector cavity and including an outer portion and an inner portion at different locations longitudinally along the plunger, the outer portion having a first cross-sectional area, the inner portion having a second cross-sectional area that is larger than the first cross-sectional area and a plurality of surface portions including:

a guiding portion configured to substantially mate with and directly slide on the inner wall of the injector cavity, allowing the plunger to slidably move in a direction along the longitudinal axis and substantially preventing the plunger from laterally translating within the injector cavity; and a restriction portion formed by an exterior surface of the inner portion disposed opposite the inner wall of the injector cavity along a length of the inner portion, the restriction portion and the inner wall forming a restriction passage therebetween, the restriction portion having a uniform geometry along a length of the inner portion.

16. The injector of claim 15, wherein the restriction portion is circumferentially adjacent to the guiding portion of the plunger.

17. The injector of claim 15, wherein the restriction portion is longitudinally adjacent to a clearance portion of the inner portion, the clearance portion forming a clearance area between the exterior surface of the inner portion and the inner wall of the injector cavity that has a larger cross-sectional area than the restriction passage to minimize pressure losses in the injector cavity.

18. The injector of claim 17, wherein a circumference of the plunger includes a first guiding portion circumferentially adjacent to the restriction portion at a one longitudinal location, and a second guiding portion circumferentially adjacent to the clearance portion at a different longitudinal location.

19. An injector for injecting fuel at high pressure into the combustion chamber of an engine, comprising:

an injector body including:

an injector cavity defining an inner wall and a longitudinal axis; and an injector orifice communicating with one end of the injector cavity to discharge fuel;

a plunger being slidably disposed within the injector cavity and including an outer portion and an inner portion at different locations longitudinally along the plunger, the outer portion having a first cross-sectional area, the inner portion having a second cross-sectional area that is larger than the first cross-sectional area and a plurality of surface portions including:

a guiding portion configured to substantially mate with and directly slide on the inner wall of the injector cavity, allowing the plunger to slidably move in a direction along the longitudinal axis, but substantially preventing the plunger from laterally translating within the injector cavity; and a restriction portion formed by an exterior surface of the inner portion disposed opposite the inner wall of the injector cavity along a length of the inner portion, the restriction portion and the inner wall forming a restriction passage therebetween, the restriction portion changing a radial dimension of the inner portion along different longitudinal locations along the inner portion.

20. The injector of claim 19, wherein the restriction portion increases the radial dimension of the inner portion in an axial direction towards the injector orifice.

21. The injector of claim 19, wherein the restriction portion decreases the radial dimension of the inner portion in an axial direction towards the injector orifice.

22. The injector of claim 19, wherein the restriction portion forms a tapered profile in an axial direction along the inner portion.

23. The injector of claim 19, wherein a first radial dimension at a first end of the restriction portion is less than a second radial dimension at a second end of the restriction portion.

* * * * *